US005121541A

United States Patent [19]

Patrakis

[11] Patent Number: 5,121,541

[45] Date of Patent: Jun. 16, 1992

[54] ELECTRIC RAZOR WITH BUILT-IN MISTER

[76] Inventor: Strati G. Patrakis, 36 Sabin St., Indian Orchard, Mass. 01151

[21] Appl. No.: 790,870

[22] Filed: Nov. 12, 1991

[51] Int. Cl.[5] ..... B26B 19/44

[52] U.S. Cl. ..... 30/41; 30/34.05

[58] Field of Search ..... 30/34.05, 41, 41.5, 30/123.3; 239/102.2, 699, 690, 690.1; 261/DIG. 48

[56] References Cited

U.S. PATENT DOCUMENTS

| | | | |
|---|---|---|---|
| 2,336,806 | 12/1943 | Schenk et al. | 30/41 |
| 3,103,299 | 9/1963 | Werft | 30/41 |
| 3,252,217 | 5/1966 | Werft | 30/41 |
| 3,299,506 | 1/1967 | Gwinn | 30/41 |
| 3,359,634 | 12/1967 | Beck | 30/41 |
| 4,031,618 | 6/1977 | Mansfield | 30/41 X |
| 4,085,893 | 4/1978 | Durley . | |
| 4,238,425 | 12/1980 | Matsuoka et al. . | |
| 4,257,989 | 3/1981 | Nishikawa . | |
| 4,479,609 | 10/1984 | Maeda et al. . | |
| 4,733,468 | 3/1988 | Zadro . | |
| 4,877,989 | 10/1989 | Drews et al. . | |
| 4,882,096 | 11/1989 | Rueben . | |

FOREIGN PATENT DOCUMENTS

| | | | |
|---|---|---|---|
| 974390 | 2/1951 | France | 30/41 |
| 640185 | 7/1950 | United Kingdom | 30/41 |

*Primary Examiner*—Douglas D. Watts
*Attorney, Agent, or Firm*—Donald S. Holland

[57] ABSTRACT

An electric razor which houses a misting mechanism for misting a lubricating agent, such as water, cologne or beard softener on to the user's skin while shaving is shown. The misting mechanism comprises a mist conduit, a misting container and an ultrasonic vibrator. In the preferred embodiment, the ultrasonic vibrator is activated by the same power source as the electric razor and it is activated at the same time the electric razor is activated. A protective screen overlies the mist conduit to prevent whiskers from contaminating the misting mechanism.

16 Claims, 1 Drawing Sheet

ELECTRIC RAZOR WITH BUILT-IN MISTER

BACKGROUND OF THE INVENTION

The present invention relates to shaving apparatus for dispensing a friction reducing substance, commonly known as a glide agent or lubricating agent. This glide agent is applied adjacent to the cutting portion of an electric shaver to reduce the friction between the razor's surface and the skin of the user from which whiskers or hair is removed.

The electric dry shaver has been widely used for many years and its popularity is increasing. The success of the dry shaver is due to the fact that shaving with a dry shaver is simple, clean, and it can be accomplished while the user is fully dressed. This is in contrast with the wet razor where the user is typically not fully dressed and the user is required to incorporate towels, water and shaving cream into his routine.

Users of dry shavers have repeatedly complained that the friction associated with dry shaving makes this daily exercise uncomfortable. In the past, there have been many designs to alleviate this problem. For example, at least one invention strives to create a shaver which will automatically and gradually disperse a lotion or other liquid at the shaver's cutting head. See U.S. Pat. No. 3252217 to Werft. While this device may alleviate the pain associated with the friction, it causes additional problems. The lotion dispersed from the shaver is not returned to the shaver in any kind of disposable container. Instead, the lotion, together with the shaved whiskers, continue to be smeared around on the user's face. In addition, some users may be allergic to, or at least sensitive to, the lotion installed by the manufacturer. If this were true, the user would encounter even more redness and irritation than if he had shaved with a dry shaver with no glide agent. Finally, the glide agent which is dispensed may not be dispensed in a steady and unvarying flow.

Accordingly, it is the primary object of the present invention to provide an electric shaver which dispenses a glide agent in a steady flow.

It is a specific object to provide an electric shaver with an internal ultrasonic mister that dispenses a soothing mist to soften the user's skin.

It is a further object to provide a razor that can be easily filled with a lubricating agent such as ordinary tap water.

The above and other objects and advantages of this invention will become more readily apparent when the following description is read in conjunction with the accompanying drawings.

SUMMARY OF THE INVENTION

To overcome the deficiencies of the prior art and to achieve the objects listed above, Applicant has invented an electric razor which dispenses a fine mist of lubricating agent, such as water, cologne or beard softener.

In the preferred embodiment, the invention comprises an electric shaver having a built-in or internal mister. The misting mechanism is comprised of a misting container, attached to the inside of the shaver's outer housing, for storing a lubricating agent; an ultrasonic mister, located inside the container, for misting the agent; and a mist conduit that directs the mist through the top of the shaver.

When a user wants to shave with this invention, he first fills the misting container by pouring a lubricating agent into an inlet spout. He then turns on the razor, which automatically activates the ultrasonic vibrator. The ultrasonic vibrator discharges a mist of lubricating agent through the mist conduit, out the standard holes in the top of the shaver, and onto the user's skin.

While in use, the user's whiskers will fall back onto the shaver. To prevent the whiskers from entering the mist conduit, a protective screen covers the top of the mist conduit.

DETAILED DESCRIPTION OF THE PREFERRED EMBODIMENTS

Figure 1:
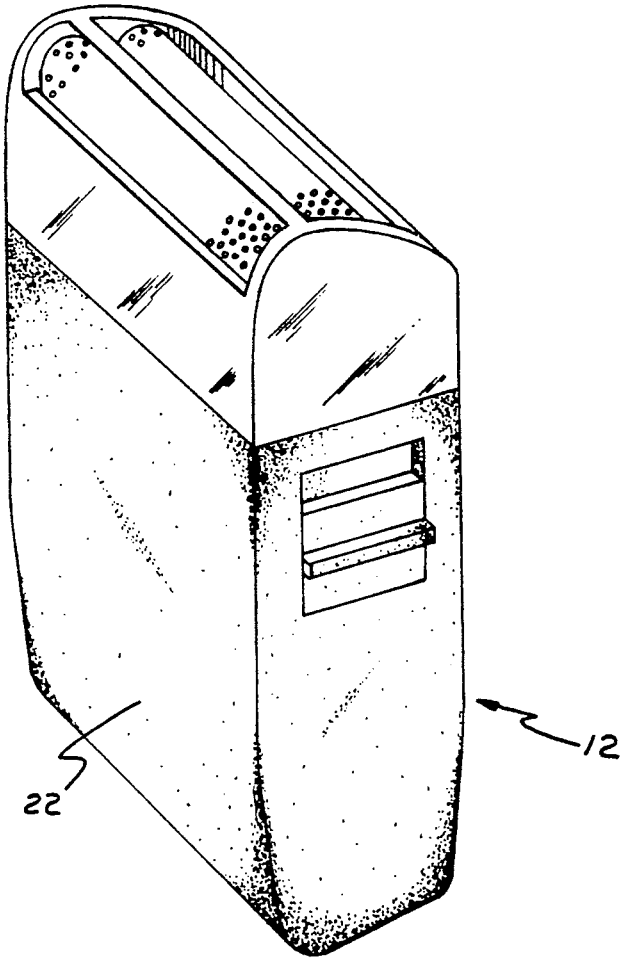
Fig.1. Prior Art
FIG. 1 is a top perspective view of a prior-art electric razor, which could be used to house the present invention.
Figure 2:
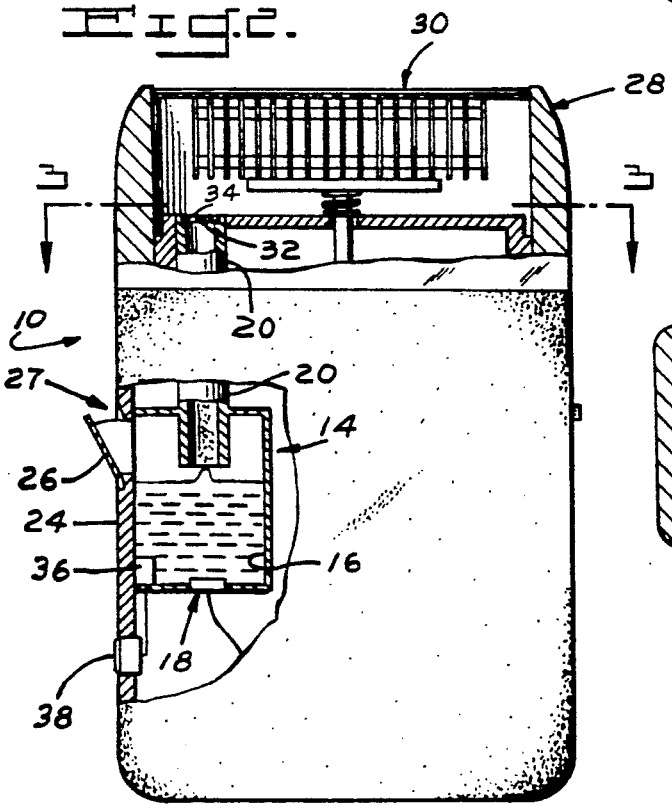
FIG. 2 is a side plan view of the prior art disclosed in FIG. 1, with portions broken away to show the present invention.
Figure 3:
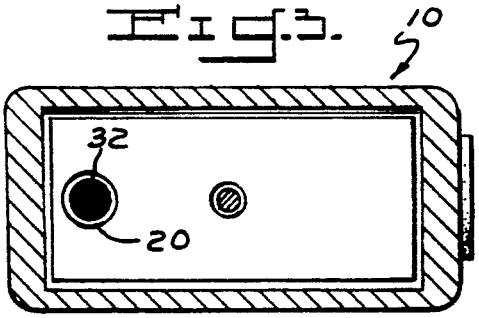
FIG. 3 is a cross-sectional view taken along line 3—3 of FIG. 2.
Figure 4:
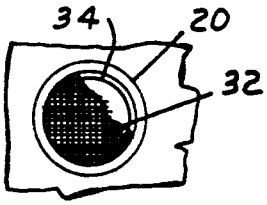
FIG. 4 is an enlarged view of a protective screen, shown in FIG. 3, but partially broken away.

Referring to the drawings in detail, the preferred embodiment of an electric razor, nicknamed the MIST TM razor, is shown and generally designated by the reference numeral 10. The invention basically comprises a standard electric shaver 12 (see FIG. 1) with additional internal elements: a misting mechanism 14 comprised of a misting container 16, an ultrasonic vibrator 18, and a mist conduit 20, as shown in FIGS. 2–4.

The preferred misting container 16 is constructed of any suitable light-weight plastic. It is located just inside the shaver's standard outer housing 22. The container 16 shares a common wall portion with the left-hand side wall 24 of the outer housing, as viewed in FIG. 2.

A lubricating agent such as water can be poured into the misting container 16, through an inlet slot of a spout or small trough 26 in side wall 24. The spout 26 is hinged at its bottom, so that it can be pivoted to open or close. When closed, the underside of the spout is flush with the rest of side wall 24. There is a thumbnail notch 27, above the spout, in wall 24 to assist in prying open the spout.

The ultrasonic vibrator 18 is located in the bottom of the misting container 16. It is powered off the same power source (not shown) used to generize the shaver. It is a miniaturized version of the standard vibrator shown in U.S. Pat. No. 4257989 to Nishikawa, and referenced therein as numeral 2. That patent is hereby incorporated by reference.

The mist conduit 20 is also made of any suitable light-weight plastic. It is attached to the top of the misting container 16 and extends upwardly, toward the top 28 of the shaver 10. The top 28 contains a row of holes 30, which allow the mist to exit the shaver 10. The mist conduit 20 also has a protective fine-wire screen 32. This screen rests on a shoulder 34, atop the mist conduit 20. The shoulder 34 is created by a step-down in the wall of the conduit 20. See FIG. 4. This protective screen 32 ensures that cut whiskers do not fall back into the MIST TM razor 10 and contaminate the misting mechanism 14.

In operation, the user inserts his fingernail into notch 27 and pries the spout 26 open. Then, he fills the misting container 18 by pouring a lubricating agent into the inlet slot. The lubricating agent then flows into the misting container 18, until the misting container is full.

When the user turns on his MIST TM razor 10, the ultrasonic vibrator 18 is automatically activated because it is powered off the same source. The ultrasonic vibrator 18 discharges a mist through the mist conduit 20, through the protective screen 32, out the exit holes 30, and onto the user's skin.

When the user completes his shave, he can simply turn off the shaver 10, allowing the remaining lubricating agent to rest in the shaver until the user desires to use the shaver 10 again. If the user desires to discard the remaining lubricating agent, he may leave the shaver 10 running until the misting container 16 is emptied. Then, he would turn off the electric shaver 10. Or, the user could empty the misting container 16 by opening the spout 26 and turning the MIST TM razor 10 upside down. After the misting container 16 is emptied, the user then returns the spout to its "closed" original position (so that it is flush with the razor housing).

Kindly note that the preferred misting mechanism 14 also has a standard electronic sensor 36 which gauges the amount of lubricating agent inside the misting container 16. When the lubricating agent level within the misting container 16 is too low, the sensor 36 will activate a warning light 38 on the side 24 of the MIST TM razor 10. The warning light 38 notifies the user that more lubricating agent should be poured into the lubricating agent inlet slot and ultimately into the misting container 16. When the misting container 16 is filled, the electronic sensor 36 deactivates the warning light 38. When the misting container 16 is empty, the user will not be able to receive a mist-spray. Hence, he will know to refill the misting container 16, even if he is unaware that the warning light 38 is activated. Due to this awareness, the warning light is not technically needed.

The electric shaver 12, which has been modified to incorporate the misting mechanism 14, can be any typical dry electric shaver. However, all the wires of the shaver circuitry must be insulated sufficiently to ensure that no electrical hazard will arise should some lubricating agent escape from the misting mechanism 14. In any typical shaver, the misting mechanism 14 rests in the lower portion of the MIST TM razor 10.

In an alternate embodiment (not shown), the ultrasonic vibrator 18 could have its own driving circuit. One such vibrator driving circuit was previously disclosed in U.S. Pat. No. 4257989 to Nishikawa (see that patent's FIG. 14). In the alternate embodiment for the present invention, the user would ideally be able to activate the misting mechanism 14 with a separate switch (not shown) on the side of the shaver 10. In this embodiment, the ultrasonic vibrator 18 would have a separate power switch, but still run off the shaver's power source. Consequently, the user could proceed through his whole routine without exercising his option to utilize the misting mechanism 14. Hence, the MIST TM razor 10, in its alternate embodiment, could operate the same as any dry shaver.

In another alternate embodiment (not shown), a check valve could be affixed at the lower portion of the mist conduit 20. The check valve would ensure that no lubricating agent leaks from the misting container 16, through the mist conduit 20, and out the holes 30 of the shaver 10, except when the misting mechanism 14 is activated. The check valve can be any suitable check valve such as a ball-and-spring check valve or a solenoid-type check valve.

It should be understood by those skilled in the art that obvious modifications can be made without departing from the spirit of the invention. Accordingly, reference should be made to the accompanying claims, rather than the foregoing specifications, to determine the scope of the invention.

Having thus described the invention, what is claimed is:

1. An electric razor comprising:

a an electric shaver housing having a top, a bottom, and two sides;

b. a misting container located inside the housing, and attached thereto, for containing an amount of lubricating agent;

c. a mist conduit attached to the misting container and extending upwardly therefrom, in fluid communication with a series of holes in the top, to allow a discharge of mist through the housing;

d. an ultrasonic vibrator in the misting container for misting the lubricating agent therein;

e. an electronic circuit means operatively connected to the vibrator for energizing the vibrator; and f. a power source means disposed in the shaver housing for supplying electric current to the ultrasonic vibrator.

2. The electric razor of claim 1 wherein a spout is pivotally attached to a side of the misting container to provide access for filling the container with lubricating agent.

3. The electric razor of claim 1 wherein a warning light is recessed in the housing of the shaver and cooperates with a level sensor in the misting container to indicate when the lubricating agent level is too low.

4. The electric razor of claim 1 wherein a protective screen is attached to the top of the mist conduit.

5. The misting container of claim 1 wherein a check valve is located in the mist conduit.

6. The ultrasonic vibrator of claim 1 wherein said vibrator is powered off the same source as the shaver.

7. The ultrasonic vibrator of claim 1 wherein said vibrator is powered off its own separate power source.

8. An electric razor comprising:

a. an electric shaver housing containing a top, a bottom, and two sides;

b. a misting container located in the shaver housing, and attached thereto, for containing an amount of lubricating agent, said container having one side portion integral and common with a side portion of the shaver housing;

c. a mist conduit connected to the misting container and extending upwardly therefrom toward holes in an upper portion of the shaver, whereby said conduit allows a discharge of mist through the housing;

d. an ultrasonic vibrator mounted liquid-tight in the misting container housing, which generates an oscillation with a frequency in the ultrasonic range, said vibrator comprising a vibrating assembly and an electronic circuit means operatively connected to said assembly for energizing said assembly and causing said assembly to vibrate; and e. a power source means disposed in said housing for supplying electric current to said electronic circuit means.

9. The electric razor of claim 8 wherein a trough of a lubricating agent inlet slot is pivotally attached to a side of the mist container to provide access for filling the container with lubricating agent.

10. The electric razor of claim 8 wherein a warning light is recessed in the housing of the shaver and cooperates with a level sensor in the misting container to indicate when the lubricating agent level is too low.

11. The electric razor of claim 8 wherein an overlying protective screen is fixed to the misting conduit.

12. The misting container of claim 8 wherein a check valve is located in the mist conduit.

13. The ultrasonic vibrator of claim 8 wherein said vibrator is powered off the same source as the shaver.

14. The ultrasonic vibrator of claim 8 wherein said vibrator is powered off its own separate power source.

15. In an electric razor of the type having an outer housing, cutting blades and a power source, the improvement comprising a misting container located inside the housing, and attached thereto, for storing a lubricating agent; a mist conduit extending from the misting container to an upper portion of said housing, wherein the conduit is in fluid communication with a series of holes in a top of the housing; an ultrasonic vibrator mounted in the misting container for misting a lubricating agent therein; and an electronic circuit means operatively connected to said vibrator for energizing said vibrator, wherein said vibrator is powered off the same power source used to energize the shaver.

16. An electric razor comprising:

a. an electric shaver housing containing a top, a bottom, and two sides;

b. a misting container located inside the housing, and affixed thereto, said container having a side portion integral and common with a side portion of the shaver housing, wherein said common side portions comprise a trough that is pivotally attached to the misting container to provide access for filling the container with lubricating agent;

c. a warning light recessed in the housing of the shaver and electrically connected to a level sensor in the misting container to indicate when a lubricating agent level is too low;

d. a mist conduit attached to the misting container housing and extending upwardly therefrom to an upper portion of the shaver, wherein the conduit is in fluid communication with a series of holes in the shaver top to allow a discharge of mist through the housing;

e. an overlying protective screen attached to the mist conduit to prevent whiskers from falling into the conduit;

f. an ultrasonic vibrator in the misting container for misting the lubricating agent therein, comprising an electronic circuit means operatively connected to said vibrator for energizing said vibrator, wherein said vibrator is powered off the same source as the shaver; and g. a power source means disposed in razor's housing for supplying electric current to said ultrasonic vibrator.

* * * * *